US006575289B2

(12) United States Patent
Hiramoto et al.

(10) Patent No.: US 6,575,289 B2
(45) Date of Patent: Jun. 10, 2003

(54) APPARATUS AND METHOD FOR FEEDING SPOUT-EQUIPPED BAGS TO BAG FILLING AND PACKAGING MACHINE

(75) Inventors: Shinichi Hiramoto, Iwakuni (JP); Kakue Nakamoto, Iwakuni (JP)

(73) Assignee: Toyo Jidoki Co., LTD

( * ) Notice: Subject to any disclaimer, the term of this patent is extended or adjusted under 35 U.S.C. 154(b) by 106 days.

(21) Appl. No.: 09/971,818

(22) Filed: Oct. 5, 2001

(65) Prior Publication Data

US 2002/0060136 A1 May 23, 2002

(30) Foreign Application Priority Data

Oct. 31, 2000 (JP) ..... 2000-332448

(51) Int. Cl.[7] ..... B65G 29/00
(52) U.S. Cl. ..... 198/485.1; 198/681; 198/433
(58) Field of Search ..... 141/313; 198/485.1, 198/433, 681

(56) References Cited

U.S. PATENT DOCUMENTS

| | | | | |
|---|---|---|---|---|
| 995,798 A | * | 6/1911 | McCullough | 118/31 |
| 3,596,430 A | | 8/1971 | Parish | |
| 4,510,737 A | | 4/1985 | Ellert | |
| 6,499,280 B1 | * | 12/2002 | Tsutsui | 53/570 |

FOREIGN PATENT DOCUMENTS

| | | |
|---|---|---|
| JP | 353092 | 12/1991 |
| WO | 9801976 | 4/1998 |

* cited by examiner

*Primary Examiner*—Christopher P. Ellis
*Assistant Examiner*—Richard Ridles
(74) *Attorney, Agent, or Firm*—Galgano & Burke

(57) ABSTRACT

A spout-equipped bag feed apparatus allows an increased number of spout-equipped bags to be stored. A plurality of conveyor rails are attached to a conveying device at a predetermined space and carried along an endless track. Each conveyor rail is capable of being loaded with and unloaded of a plurality of spout-equipped bags from one end thereof and capable of supporting the spout portions of the bags in such a manner that the bags are movable in the axial direction. Loading of bags into the conveyor rail is effected with a bag loading tool capable of being loaded with and unloaded of bags from one end thereof and capable of supporting the spout portions of the bags in such a manner that the bags are movable in the axial direction. The one end of the bag loading tool is butted against the one end of the conveyor rail, and the bags are pushed into the conveyor rail. From conveyor rails conveyed to a bag unloading position along the endless track of the conveying device, the bags are unloaded and sent to a receiving device by an unloading device. The bags received by the receiving device are successively supplied to bag holding members of a packaging machine by a bag delivery device.

9 Claims, 6 Drawing Sheets

31
35a
39
66
37a
51a
33
61
63
51b
37b
65
67
35b
57
59
1
23c
3
7
5
53
21a
55
21b
23b
23a
79
83
81
43a
45a
51a
41
61
63
51b
45b
67
43b

APPARATUS AND METHOD FOR FEEDING SPOUT-EQUIPPED BAGS TO BAG FILLING AND PACKAGING MACHINE

BACKGROUND OF THE INVENTION

1. Field of the Invention

The present invention relates to an apparatus for feeding spout-equipped bags to a filling and packaging machine using them. More particularly, the present invention relates to a spout-equipped bag feed apparatus capable of storing an increased number of spout-equipped bags and hence capable of reducing the number of times at which the bag feed apparatus must be replenished with spout-equipped bags, thus allowing the operating efficiency to be increased. The present invention also relates to a spout-equipped bag feed method making it possible to store an increased number of spout-equipped bags and to reduce the number of times at which the bag replenishing operation must be performed, thereby allowing the operating efficiency to be increased. Further, the present invention relates to a bag loading tool suitable for use in loading bags into a spout-equipped bag feed apparatus.

2. Discussion of Related Art

Bags fitted with spouts are used as packaging containers for beverages. Spout-equipped bags are fitted with spouts in advance in the bag making process in such a manner that the spouts project from the bags. Thereafter, the spout-equipped bags are supplied to a spout-equipped bag packaging machine to fill the bags with a material to be packed.

When spout-equipped bags are supplied to the filling and packaging machine from a bag feed apparatus, the bags may be stored, for example, in a magazine of the bag feed apparatus. In such a case, because the spout-equipped bags are bulky owing to the projecting spout portions, the magazine can store only an extremely small number of spout-equipped bags in comparison to spoutless bags. Accordingly, the operating efficiency is unfavorably low. In addition, there is an extremely large difference in thickness between the top of the bag, which is fitted with a spout, and the bottom of the bag. Therefore, spout-equipped bags lack stability when they are piled on each other.

To solve the above-described problems, Japanese Patent No. 2500557, for example, discloses an apparatus arranged as follows. Magazines holding nozzled pouches are carried on a chain conveyor with attachments. A magazine reaching one end of the conveyor is moved to a predetermined position by a relay conveyor. At this position, the pouches are unloaded from the magazine with a pusher and transferred to an accumulator rail, from which the pouches are successively supplied to a filling and sealing packaging machine. Meanwhile, the emptied magazine is moved to an empty magazine accumulating section by a relay conveyor.

However, with the achievement of an increased operating speed of filling and packaging machines, an arrangement capable of storing an increased number of spout-equipped bags has been demanded. With the feed apparatus disclosed in Japanese Patent No. 2500557, only the upper side of the chain conveyor is used to hold magazines. Therefore, the number of bags that can be held per unit installation area is limited. In order to increase the number of spout-equipped bags that can be stored, it is necessary to increase the length of the track of the chain conveyor for carrying magazines. This causes the installation area of the apparatus to increase correspondingly.

SUMMARY OF THE INVENTION

The present invention was made in view of the above-described problems associated with the prior art.

Accordingly, an object of the present invention is to provide a spout-equipped bag feed apparatus and method capable of storing an increased number of spout-equipped bags per unit installation area of the apparatus.

Another object of the present invention is to provide a bag loading tool suitable for use in loading bags into the above-described apparatus.

To attain the above-described objects, the present invention provides a spout-equipped bag feed apparatus wherein a plurality of holding members for conveying bags are attached to a conveying device with an endless track at a predetermined space so as to be movable along the entire circumference of the endless track. Each holding member for conveying bags is of continuous length and has a bag support portion capable of being loaded with and unloaded of a plurality of spout-equipped bags at at least one end in the axial direction thereof. The bag support portion is adapted to hold the spout portions of the spout-equipped bags in such a manner that the spout-equipped bags are movable in the axial direction of the bag support portion. The holding members for conveying bags are attached to the conveying device in such a manner that the axial direction of the holding members for conveying bags extends in a direction perpendicularly intersecting the conveying direction of the conveying device. The apparatus further includes an unloading device for unloading the spout-equipped bags from one end of one of the holding members for conveying bags conveyed to a bag unloading position provided at a predetermined position along the endless track of the conveying device. A bag receiving device receives the spout-equipped bags unloaded from the holding member for conveying bags. A delivery device successively delivers the spout-equipped bags from the bag receiving device to bag holding members of a packaging machine.

In one embodiment of the present invention, each holding member for conveying bags is arranged to hold the spout-equipped bags in such a manner that the bag portions of the spout-equipped bags extend from the holding member for conveying bags outward of the endless track.

Further, the holding member for conveying bags may be arranged as follows. The holding member for conveying bags has a tubular member, at least one end of which is open. The tubular member is formed with a slit extending from the open end in the axial direction of the tubular member. The slit constitutes the bag support portion.

In addition, the present invention provides a bag loading tool suitable for use in loading spout-equipped bags into the holding members for conveying bags of the above-described spout-equipped bag feed apparatus. The bag loading tool is formed as a member of continuous length and has a bag support portion capable of being loaded with and unloaded of a plurality of spout-equipped bags at at least one end in the axial direction thereof. The bag support portion holds the spout portions of the spout-equipped bags in such a manner that the spout-equipped bags are movable in the axial direction of the bag support portion. A guide portion is formed at at least either one of the one end of each holding member for conveying bags and the one end of the bag loading tool to guide and position the other of them. When the one end of the bag loading tool is butted against the one end of the holding member for conveying bags through the guide portion, the spout-equipped bags are movable from the bag support portion of the bag loading tool to the bag support portion of the holding member for conveying bags so as to be loaded thereinto.

In addition, the present invention provides a spout-equipped bag feed apparatus including a holding member for conveying bags of continuous length that has a bag support portion capable of being loaded with and unloaded of a plurality of spout-equipped bags at at least one end in the axial direction thereof. The bag support portion holds the spout portions of the spout-equipped bags in such a manner that the spout-equipped bags are movable in the axial direction. The apparatus further includes a conveying device having an endless track. A plurality of the holding members for conveying bags are attached to the conveying device at a predetermined space in such a manner that the axial direction of the holding members for conveying bags extends in a direction perpendicularly intersecting the conveying direction of the conveying device. The holding members for conveying bags are conveyed along the entire circumference of the endless track. An unloading device unloads the spout-equipped bags from one end of one of the holding members for conveying bags conveyed to a bag unloading position provided at a predetermined position along the endless track of the conveying device. A bag receiving device receives the spout-equipped bags unloaded from the holding member for conveying bags. A delivery device successively delivers the spout-equipped bags from the bag receiving device to bag holding members of a packaging machine. Further, the apparatus includes a bag loading tool of continuous length for loading spout-equipped bags into each holding member for conveying bags. The bag loading tool has a bag support portion capable of being loaded with and unloaded of spout-equipped bags at at least one end in the axial direction thereof. The bag support portion holds the spout portions of the spout-equipped bags in such a manner that the spout-equipped bags are movable in the axial direction. When the one end of the bag loading tool is butted against the one end of the holding member for conveying bags, the bag support portion of the bag loading tool connects with the bag support portion of the holding member for conveying bags so that the spout-equipped bags are movable from the bag loading tool to the holding member for conveying bags so as to be loaded thereinto.

In addition, the present invention provides a method of feeding spout-equipped bags to a packaging machine. The method uses a plurality of holding members for conveying bags of continuous length each capable of being loaded with and unloaded of a plurality of spout-equipped bags at at least one end in the axial direction thereof. The holding members for conveying bags hold the spout portions of the spout-equipped bags in such a manner that the spout-equipped bags are movable in the axial direction. The holding members for conveying bags are attached to a conveying device having an endless track at a predetermined space in such a manner that the axial direction of the holding members for conveying bags extends in a direction perpendicularly intersecting the conveying direction of the conveying device. The holding members for conveying bags are moved along the entire circumference of the endless track so that spout-equipped bags can be loaded into the holding members for conveying bags in an any desired order at a plurality of positions along the endless track. At a predetermined position along the endless track, the spout-equipped bags are unloaded from one end of one of the holding members for conveying bags conveyed to the position, and the unloaded spout-equipped bags are sent to the outside of the endless track. The spout-equipped bags sent out are successively supplied to the packaging machine.

In one embodiment of the present invention, spout-equipped bags are loaded into each holding member for conveying bags by using a bag loading tool. The tool is capable of being loaded with and unloaded of a plurality of spout-equipped bags at at least one end in the axial direction thereof and capable of supporting the spout-equipped bags in such a manner that the spout-equipped bags are movable in the axial direction. The one end of the bag loading tool is butted against the one end of the holding member for conveying bags, whereby the spout-equipped bags held on the bag loading tool are moved to the holding member for conveying bags so as to be loaded thereinto.

In another embodiment of the present invention, a guide portion is formed at at least either one of the one end of the holding member for conveying bags and the one end of the bag loading tool to guide and position the other of them, thereby facilitating the bag loading operation.

Other objects and advantages of the present invention will become apparent from the following detailed description of illustrated embodiments of the invention.

DETAILED DESCRIPTION OF THE PREFERRED EMBODIMENTS

Embodiments of the present invention will be described below with reference to the accompanying drawings. It should be noted, however, that the scope of the present invention is not limited to the embodiments stated below.

Figure 1:
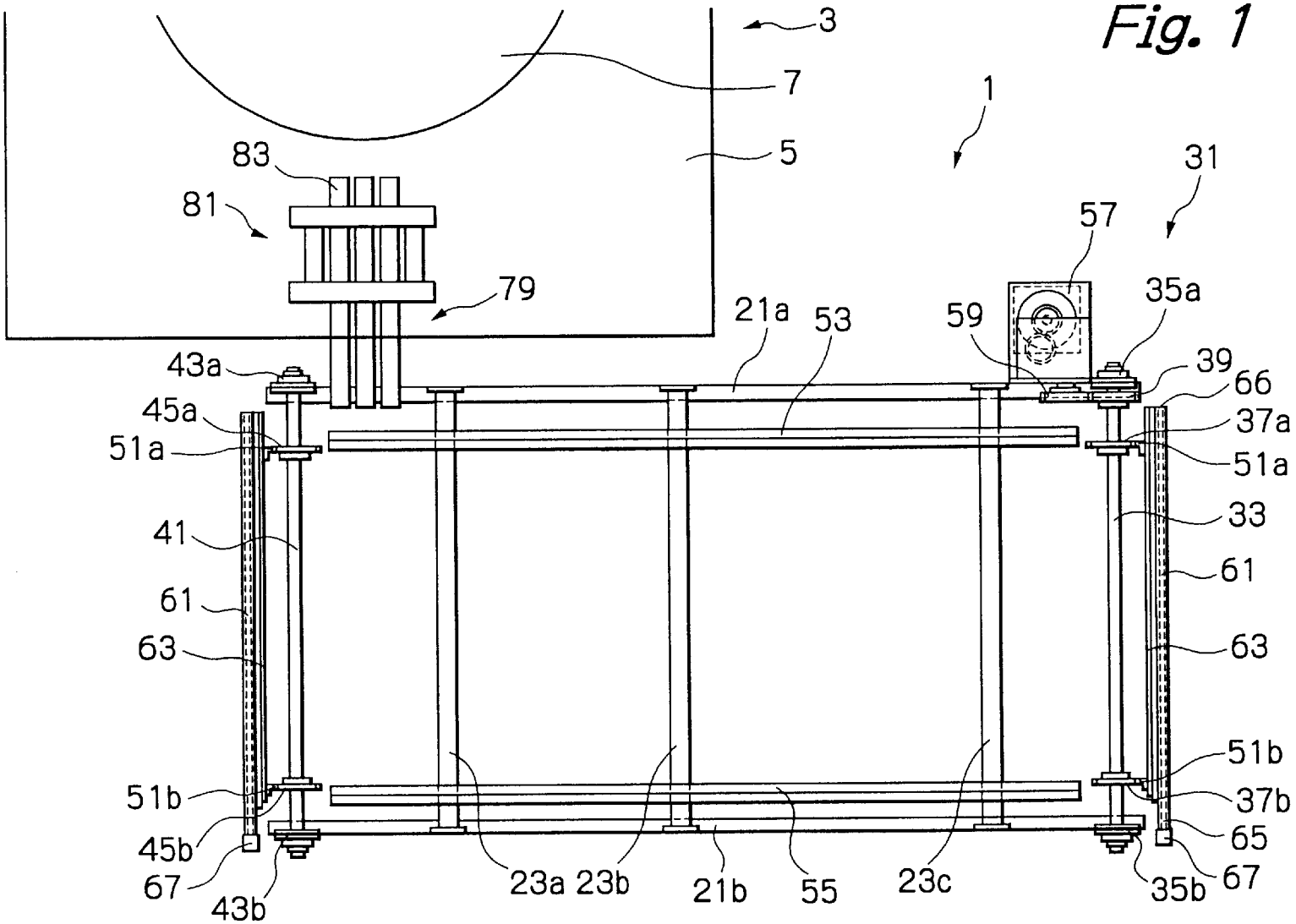
FIG. 1 is a schematic plan view of a spout-equipped bag feed apparatus according to an embodiment of the present invention.
Figure 2:
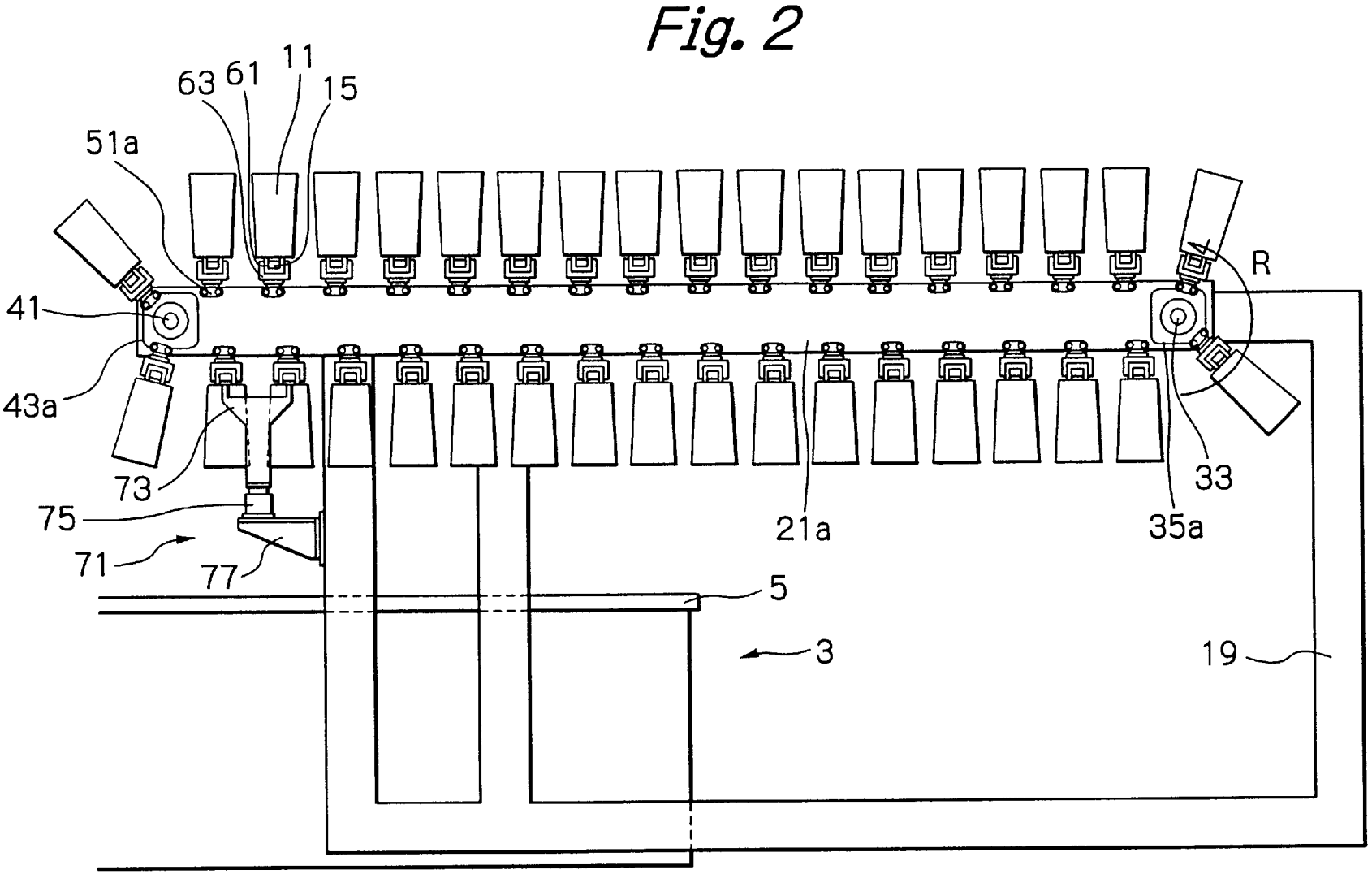
FIG. 2 is a schematic front view of the spout-equipped bag feed apparatus.
Figure 3:
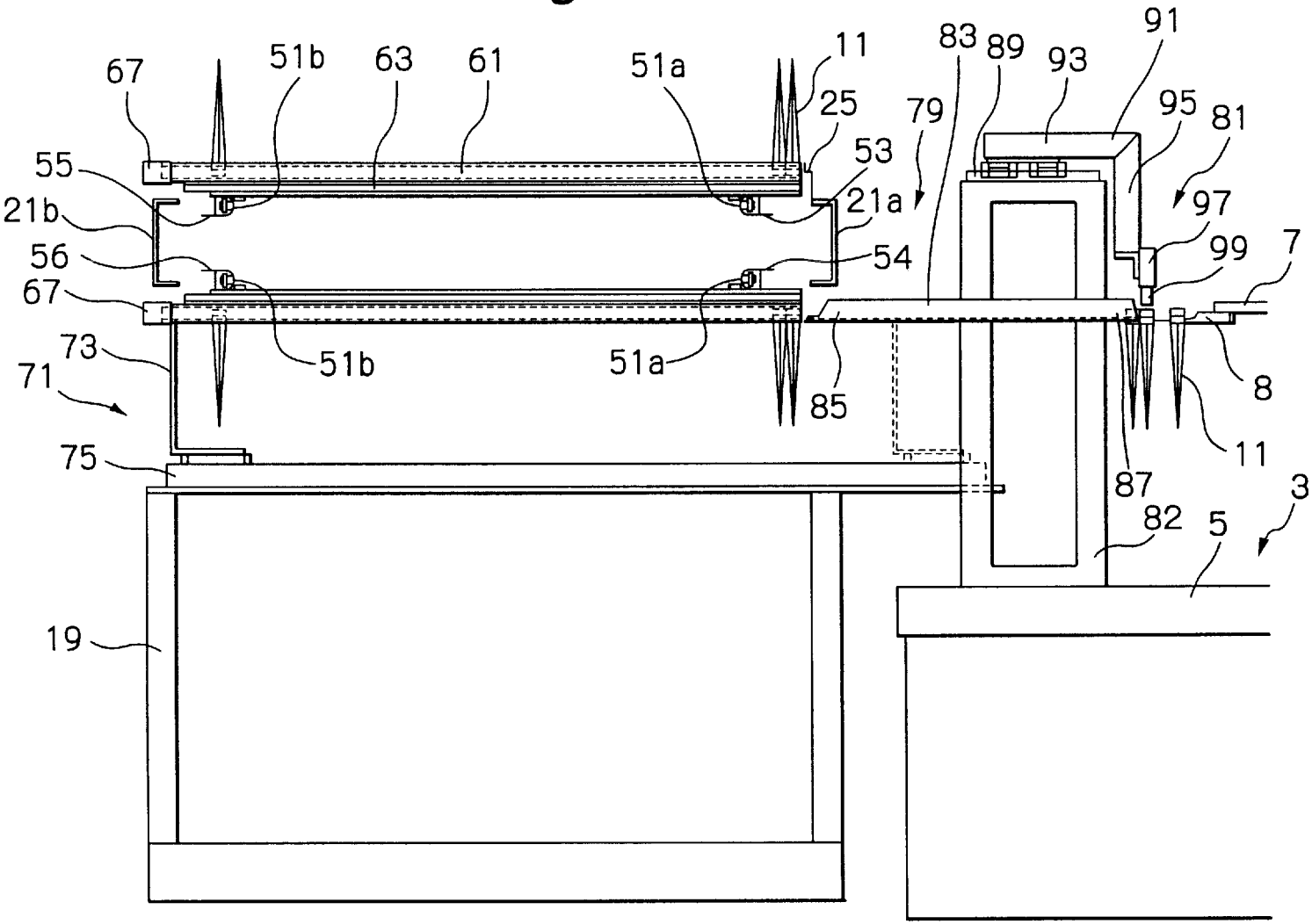
FIG. 3 is a schematic side view of the spout-equipped bag feed apparatus.

FIG. 1 is a plan view schematically showing the arrangement of a spout-equipped bag feed apparatus 1 according to an embodiment of the present invention. FIGS. 2 and 3 are schematic front and side views, respectively, of the spout-equipped bag feed apparatus 1.

The spout-equipped bag feed apparatus 1 supplies spout-equipped bags 11 (described later) to a filling and packaging machine 3 shown above the spout-equipped bag feed apparatus 1 in FIG. 1. The spout-equipped bag feed apparatus 1 includes conveyor rails 61, a conveying device 31, an unloading device 71, a receiving device 79, and a bag delivery device 81, which will be described later in detail.

Figure 4:
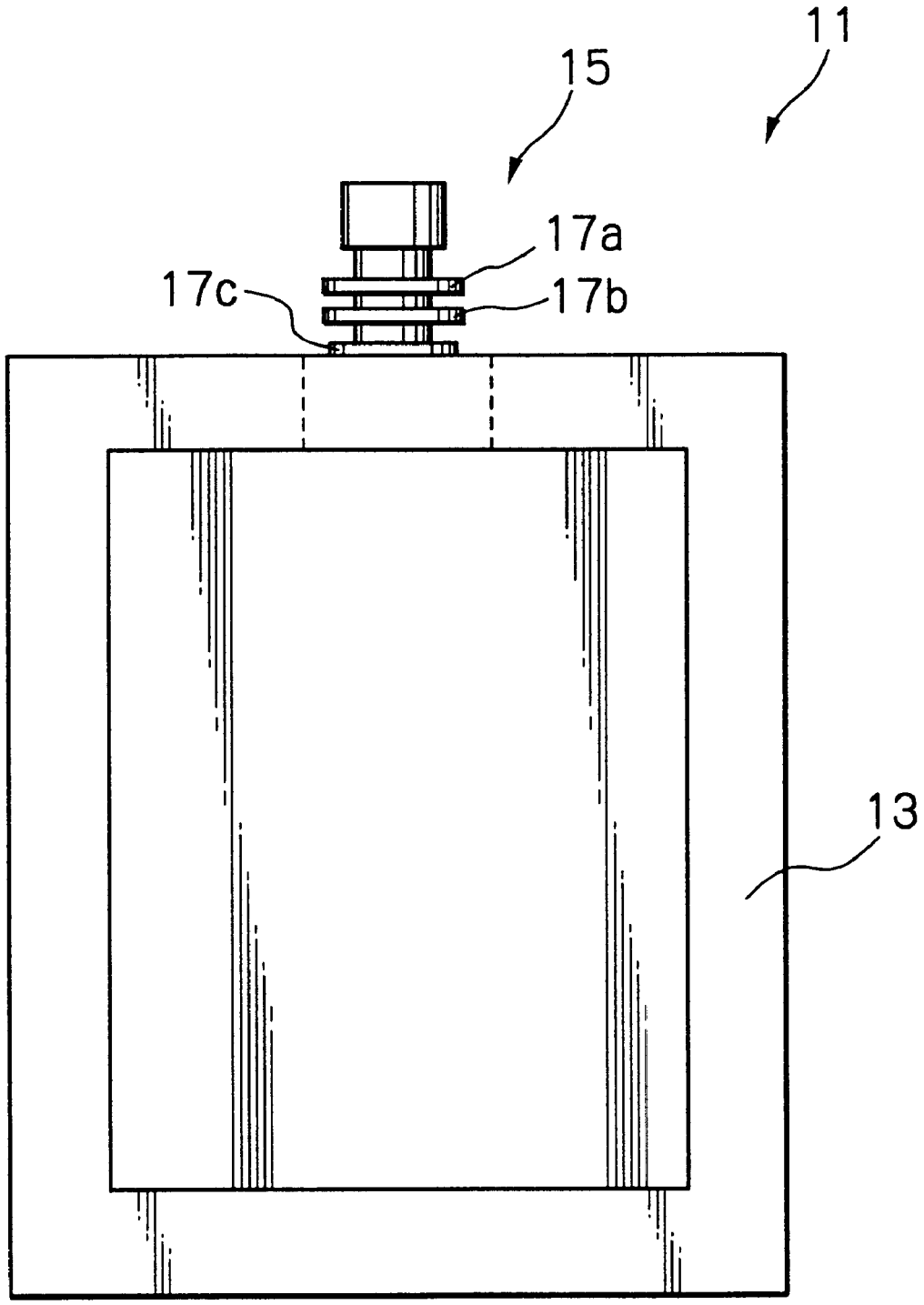
FIG. 4 is a front view of a spout-equipped bag used in the spout-equipped bag feed apparatus.

FIG. 4 shows a spout-equipped bag 11. The spout-equipped bag 11 has a bag portion 13 formed from a laminated composite material consisting essentially of aluminum foil and a synthetic resin film. A spout 15 is fitted to the center of the upper side (as viewed in the figure) of the bag portion 13 in such a manner as to project therefrom by a predetermined length. The portion of the spout 15 that projects from the bag portion 13 is formed with three radially extending flanges 17*a,* 17*b* and 17*c* at predetermined positions in order from the upper side. The lowermost flange 17*c* abuts on the upper end of the bag portion 13 to position the spout 15 with respect to the bag portion 13.

Meanwhile, the filling and packaging machine 3 has an intermittently rotary table 7 provided on a base 5, as shown in FIG. 1. Bag holding members 8 (see FIG. 3) are provided on the intermittently rotary table 7 at predetermined spaces in the circumferential direction. The filling and packaging machine 3 fills each bag 11 with a material to be packed and then seals the bag 11 to produce a packaged article. The filling and packaging machine 3 is publicly known. Therefore, a further detailed description thereof is omitted. It should be noted that the filling and packaging machine 3 processes two bags 11 simultaneously at each step, and the bag feed apparatus 1 (described below) also supplies two bags 11 at a time to the filling and packaging machine 3. The upper two flanges 17*a* and 17*b* of the bag 11 are used to hold the bag 11 when handled at the bag feed apparatus 1 or the filling and packaging machine 3.

In FIGS. 2 and 3, a base frame 19 has side frames 21*a* and 21*b* attached thereto. The side frames 21*a* and 21*b* extend in vertical planes, respectively, in parallel to each other. Stays 23*a*, 23*b* and 23*c* are disposed parallel to each other between the side frames 21*a* and 21*b* and each secured to the side frames 21*a* and 21*b* at both ends thereof.

The bag feed apparatus 1 has a conveying device 31 for moving conveyor rails 61 (described later). The conveying device 31 has a driving shaft 33. The driving shaft 33 has both ends rotatably supported by respective bearings 35*a* and 35*b* secured to portions of the side frames 21*a* and 21*b* near the right-hand ends thereof as viewed in FIG. 1. The driving shaft 33 has sprocket wheels 37*a* and 37*b* secured thereto at axially spaced positions slightly away from both ends of the driving shaft 33. The sprocket wheels 37*a* and 37*b* have the same configuration. Further, a gear 39 is secured to the driving shaft 33 at the inner side of the upper side frame 21*a* as viewed in FIG. 1.

A driven shaft 41 is rotatably supported by bearings 43*a* and 43*b* secured to portions of the side frames 21*a* and 21*b* near the left-hand ends thereof as viewed in FIG. 1. The bearings 43*a* and 43*b* are installed at approximately the same height as the bearings 35*a* and 35*b* for the driving shaft 33. Further, the driven shaft 41 has sprocket wheels 45*a* and 45*b* secured thereto at axially spaced positions corresponding to the positions of the sprocket wheels 37*a* and 37*b* on the driving shaft 33. The sprocket wheels 45*a* and 45*b* have the same configuration as that of the sprocket wheels 37*a* and 37*b*.

A chain 51*a* passes over the sprocket wheels 37*a* and 45*a* so as to rotate around the stays 23*a*, 23*b* and 23*c*. Another chain 51*b* passes over the sprocket wheels 37*b* and 45*b* so as to rotate around the stays 23*a*, 23*b* and 23*c*. The chains 51*a* and 51*b* have the same length and the same pitch. It should be noted that only the left and right end portions of the chains 51*a* and 51*b* are shown in FIG. 1.

Guide rails 53, 54, 55 and 56 are secured to the side frames 21*a* and 21*b* by appropriate devices to guide the associated chains 51*a* and 51*b* along the direction of movement thereof. A motor 57 has a gear 59 secured to the output shaft thereof at the inner side of the side frame 21*a*. The gear 59 is in mesh with the gear 39 secured to the driving shaft 33 to drive the driving shaft 33. When the driving shaft 33 is driven to rotate, the chains 51*a* and 51*b* rotate, causing the driven shaft 41 to rotate. The direction of rotation of the chains 51*a* and 51*b* is indicated by the arrow R shown in FIG. 2.

Figure 5:
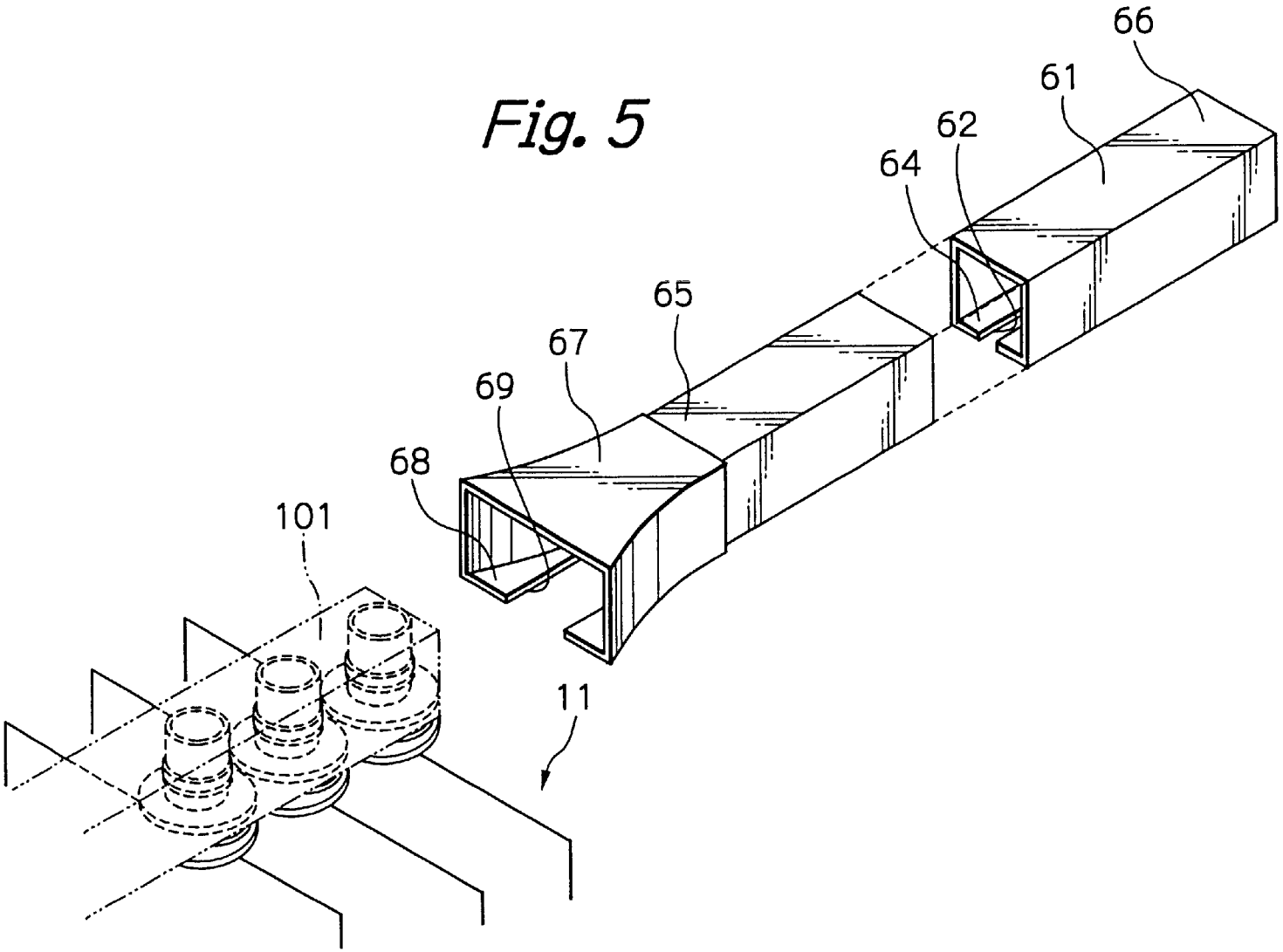
FIG. 5 is a perspective view showing a conveyor rail and a guide member.

The conveyor rails 61 serve as holding members for conveying bags for conveying a plurality of bags 11 held thereon. As shown in FIG. 5, each conveyor rail 61 is formed in the shape of a tube with a quadrangular cross-sectional configuration having a through-hole. The conveyor rail 61 has a slit or opening 62 in the center of one side wall thereof, more specifically, in the center of the lower wall 64. The slit 62 extends axially from one end 65 to the other end 66. The width of the slit 62 is larger than the diameter of the spout 15 of each bag 11 but smaller than the diameter of the flange portion 17. Therefore, each bag 11 can be loaded into the conveyor rail 61 from the one end 65 thereof in such a manner that the upper two flanges 17*a* and 17*b* of the spout 15 sandwich the lower wall 64 therebetween from the upper and lower sides. The loaded bag 11 is movable along the slit 62.

A guide member 67 is fitted to the one end 65 of the conveyor rail 61. As shown in FIG. 5, the guide member 67 has a quadrangular cross-sectional configuration similar to that of the conveyor rail 61. However, the cross-sectional area of the guide member 67 gradually increases from one end thereof fitted to the conveyor rail 61 toward the other end thereof. The lower wall 68 of the guide member 67 is formed with a slit 69 wider than the slit 62 of the conveyor rail 61. The slit 69 extends over the entire axial length of the guide member 67. The guide member 67 will be described later again.

Each conveyor rail 61 is attached to the chains 51*a* and 51*b* through a conveyor rail attachment member 63. As shown in FIGS. 2 and 3, the attachment member 63 is an elongated member having a U-shaped sectional configuration, the upper end of which is open. The attachment member 63 is secured at both ends thereof to the outer peripheral sides of the chains 51*a* and 51*b*. More specifically, the attachment members 63 are each secured to the chains 51*a* and 51*b* at the bottom portions near both ends thereof. The attachment members 63 are disposed at predetermined spaces in the direction of travel of the chains 51*a* and 51*b* in a state where the opening portion of each attachment member 63 faces upward. It should be noted that, in FIG. 2, illustration of a link where no attachment member 63 is provided is omitted. The conveyor rail 61 is attached to each individual attachment member 63 secured to the chains 51*a* and 51*b* in a state where the wall 64 formed with the slit 62 faces outward.

In FIG. 3, a fall-preventing stopper 25 is disposed in close proximity to the ends 66 of the conveyor rails 61 to prevent the bags 11 loaded in the conveyor rails 61 from the ends 65 from falling off from the ends 66. As shown in FIG. 3, the fall-preventing stopper 25 is secured to the side frame 21*a* to extend along the direction of movement of the chain 51*a* except a position at which bags 11 are transferred from conveyor rails 61 to a transfer rail 83 (described later).

In FIGS. 2 and 3, an unloading device 71 is disposed at a predetermined position below the conveying device 31 to transfer bags 11 from conveyor rails 61 stopped at the unloading device 71, that is, at a bag unloading position, to the transfer rail 83 (described later). The unloading device 71 has a rectilinear slide type air cylinder 75 fixed to a bracket 77 secured to the base frame 19. A push member 73 is attached to the air cylinder 75 to move horizontally as viewed in FIG. 3.

The push member 73 moves from the solid-line position to the two-dot chain line position shown in FIG. 3 to push out the bags 11 from the ends 66 of the conveyor rails 61 to the transfer rail 83 (described later). As shown in FIG. 2, the push member 73 has an approximately Y-shaped configuration as viewed from the front, i.e. from this side of the plane of the figure, so as to operate for two conveyor rails 61 simultaneously. It should be noted that the fall-preventing stopper 25 is not present at the position of the push member 73, as has been stated above.

The transfer rail 83 functions as a bag receiving device 79 for holding bags 11 pushed out from the conveyor rails 61 by the unloading device 71. In this embodiment, the transfer rail 83 is formed from three plates disposed parallel to each other at predetermined spaces to receive bags 11 simultaneously sent out in two rows from two rails 83. The bags 11 are movable along the transfer rail 83 in such a manner that the respective spout portions 15 of bags 11 are fitted in two gaps defined between the three plates and the spout flanges 17 of the bags 11 slide on the plates. The transfer rail 83 is suspended by a gate-shaped frame 82 stood on the machine base 5. The transfer rail 83 is vibrated by a vibrator (not shown) provided for the transfer rail 83, thereby allowing the bags 11 to move rightward as viewed in FIG. 3 along the transfer rail 83. Alternatively, pressurized air may be blown on the bags 11 to send them forward instead of using the vibrator. In this embodiment, the transfer rail 83 is shorter in length than the conveyor rails 61. The distance between the gaps for retaining the bags 11 is the same as the distance between the slits of a pair of adjacent conveyor rails 61 attached to the chains 51*a* and 51*b*. Further, the transfer rail 83 is installed on the gate-shaped frame 82 in such a manner that the right-hand end 87 (as viewed in FIG. 3) of the transfer rail 83 is slightly lower than the left-hand end 85 thereof. First and second stoppers (not shown) are provided in the vicinity of the right-hand end 87 of the transfer rail 83. The first and second stoppers are capable of advancing and retracting. When advanced, the first and second stoppers abut on the top and second bags 11 to temporarily stop the advance of the bags 11.

A rectilinear slide type air cylinder 89 constitutes a bag delivery device 81 for delivering bags 11 to the packaging machine 3. The air cylinder 89 is installed on the top of the gate-shaped frame 82, as shown in FIG. 3 (illustration of the air cylinder 89 is omitted in FIGS. 1 and 2). The air cylinder 89 actuates an advancing and retracting frame 91 attached thereto to reciprocate horizontally as viewed in FIG. 3 by a predetermined distance. As shown in FIG. 3, the advancing and retracting frame 91 is formed in an L shape from a horizontal portion 93 secured to the top of the air cylinder 89 and a vertical portion 95 extending downward from the right-hand end of the horizontal portion 93. A chuck opening and closing air cylinder 97 is fixed to the lower end of the vertical portion 95. A gripping chuck 99 is secured to the lower end of the air cylinder 97. The gripping chuck 99 is opened and closed by the air cylinder 97. The gripping chuck 99 grips the top bags 11 on the transfer rail 83. In this state, the advancing and retracting frame 91 advances to deliver the bags 11 to a bag holding member 8 of the packaging machine 3.

The following is a description of a method of supplying bags 11 to the filling and packaging machine 3 by using the bag feed apparatus 1 arranged as stated above.

Figure 6:
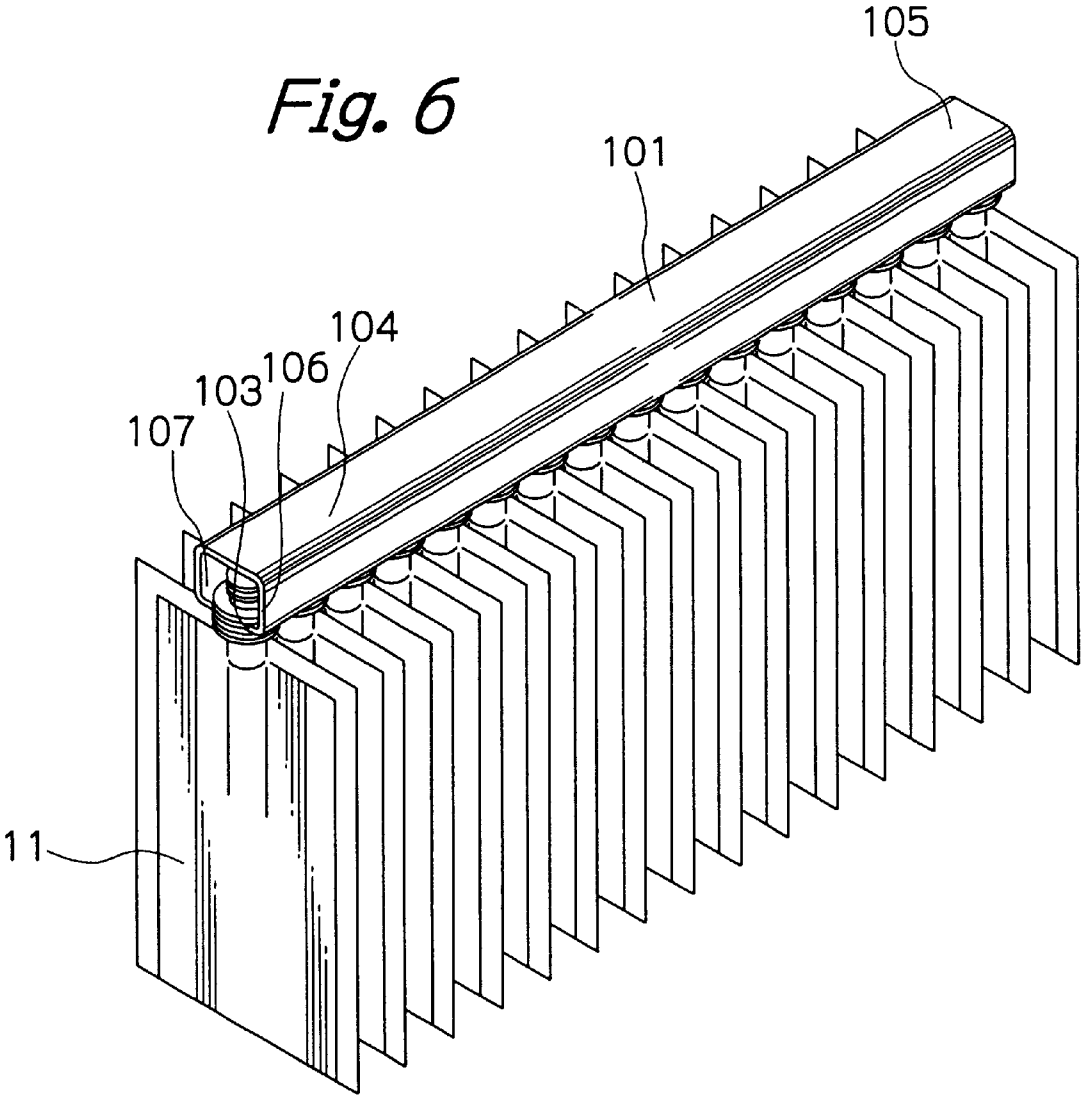
FIG. 6 is a perspective view of a bag loading tool.

First, a plurality of bags 11 are loaded into each conveyor rail 61 by using a bag loading tool 101 capable of holding a plurality of bags 11. The bag loading tool 101 has a configuration similar to that of the conveyor rail 61. As shown in FIG. 6, the bag loading tool 101 is a tubular member with a quadrangular cross-sectional configuration having a through-hole. One wall of the bag loading tool 101, i.e. the lower wall 107 as viewed in FIG. 6, is formed with an axially extending slit 103. The width of the slit 103 is larger than the diameter of the spout 15 but smaller than the diameter of the flanges 17. Therefore, a large number of bags 11 can be loaded into the bag loading tool 101 from an opening 106 in such a manner that the flanges 17 lie on the lower wall 107. The loading of bags 11 is performed during the process of producing bags 11. The openings at both ends of the bag loading tool 101 are covered with caps to prevent the bags 11 from falling off during transport. The bag loading tool 101 loaded with bags 11 and supplied in this way is inserted into a guide member 67 attached to a conveyor rail 61 (see FIG. 5) after the cap has been removed from one opening of the bag loading tool 101. The guide member 67 guides the bag loading tool 101 to a position where it butts against the conveyor rail 61 such that the axis of the bag loading tool 101 is approximately coincident with the axis of the conveyor rail 61. At this time, the slit 103 of the bag loading tool 101 and the slit 62 of the conveyor rail 61 coincide with each other. Thereafter, the spout-equipped bags 11 held on the bag loading tool 101 are pushed toward the conveyor rail 61 by hand, thereby loading the bags 11 into the conveyor rail 61. The loading operation can be performed independently of the order in which the conveyor rails 61 are arranged side by side. It is also possible to carry out the bag loading operation irrespective of whether the relevant conveyor rail 61 is located above or below the chains 51. The conveying device 31 is driven intermittently in such a way that it stops temporarily after moving through a distance corresponding to two conveyor rails 61.

While the conveying device 31 is at rest, the bags 11 are sent out to the transfer rail 83 from two conveyor rails 61 having stopped at the bag unloading position by the unloading device 71. More specifically, the air cylinder 75 is activated to move the push member 73 from the left-hand solid-line position toward the right-hand two-dot chain line position shown in FIG. 3. Thus, the bags 11 held on the conveyor rails 61 are forced to move from the left side toward the right side. In this case, first, the bags 11 are sent forward until the top bags 11 in the two rows reach the distal end 87 of the transfer rail 83, that is, the position where the bags 11 are taken out by the gripping chuck 99. At this time, some bags 11 still remain in the conveyor rails 61. The top and second bags 11 are positioned by the above-described first and second stoppers, respectively.

It should be noted that a sensor (not shown) is provided in association with the unloading device 71 to judge whether or not bags 11 are held on two conveyor rails 61 having stopped at the bag unloading position. If it is sensed that either or both of the conveyor rails 61 are empty, the conveying device 31 is further fed through a distance corresponding to one pitch (corresponding to two conveyor rails 61). The pitch-by-pitch feed of the conveying device 31 is repeated until it is sensed that both of the conveyor rails 61 are loaded with bags 11. When a pair of conveyor rails 61 loaded with bags 11 are detected, the bag unloading operation is performed by the unloading device 71.

Then, the push member 73 is intermittently advanced by one pitch (corresponding to one bag 11) at a time in synchronism with the timing at which bags 11 are successively taken out and delivered to the packaging machine 3 by the bag delivery device 81, as described later. When the push member 73 reaches the foremost end, the supply of all the bags 11 from the two conveyor rails 61 to the transfer rail 83 is completed. Then, the push member 73 returns to the previous position. Thereupon, the conveying device 31 is driven to move through a distance corresponding to one pitch (corresponding to two conveyor rails 61). The conveying device 31 stops when two subsequent conveyor rails 61 loaded with bags 11 reach the bag unloading position. Meanwhile, the bags 11 on the transfer rail 83 should preferably be advanced by the action of a vibrator, for example. Then, the push member 73 is activated again to send new groups of bags 11 until the top bags 11 in the new groups abut on the last bags 11 in the groups of bags 11 sent previously. After all the new groups of bags 11 have been sent to the transfer rail 83, the subsequent conveyor rails 61 are driven.

Although in the foregoing embodiment the push member 73 is advanced by one pitch at a time synchronously with the timing at which bags 11 are successively taken out and delivered to the packaging machine 3, the arrangement may be such that the push member 73 is advanced by a predetermined distance when it is sensed with a sensor that the last bags 11 on the transfer rail 83 have reached a predetermined position. In such a case, the vibrator should preferably be activated at all times to advance the bags 11 on the transfer rail 83.

Next, the operation of delivering bags 11 to the packaging machine 3 by the bag delivery device 81 will be described. After the presence of the top bags 11 positioned by the first stopper has been conformed with a sensor, the gripping chuck 99 of the bag delivery device 81 is closed to grip the spout portion 15, for example, of each of the top bags 11. At this time, the first stopper retracts to allow the top bags 11 to move. That is, the top bags 11 are allowed to be taken out. The advancing and retracting frame 91 advances to move the gripping chuck 99 to the packaging machine 3. After the bags 11 have been delivered to a bag holding member 8 of the packaging machine 3, the advancing and retracting frame 91 retracts. Meanwhile, the second stopper is retracted to allow the second bags 11 to advance, and the first stopper is advanced to position these bags 11. When the third bags 11 advance to a predetermined position, these bags 11 are positioned at a stop position by the second stopper that has already advanced.

In the foregoing first embodiment, the length of the transfer rail 83 is shorter than the length of each conveyor rail 61. However, the length of the transfer rail 83 may be longer than the length of each conveyor rail 61. A second embodiment in which the transfer rail 83 is longer than the conveyor rails 61 will be described below.

In the second embodiment, the way in which bags 11 are loaded from the bag loading tool 101 into each conveyor rail 61 and the way of intermittently driving the conveying device 31 are the same as in the first embodiment. The way in which bags 11 are delivered from the transfer rail 83 to the packaging machine 3 by the bag delivery device 81 is also the same as in the first embodiment.

In the second embodiment, the unloading device 71 transfers the bags 11 from the conveyor rails 61 to the transfer rail 83 as follows. First, the push member 73 is advanced to send all the bags 11 in the conveyor rails 61 to the transfer rail 83. When the senior senses that the top bags 11 reaching a predetermined position have been stopped and positioned by the first stopper, the bag delivery device 81 begins operating to deliver the bags 11 to the packaging machine 3 one after another. Meanwhile, the push member 73 retracts to the previous position, and the conveying device 31 is driven by one pitch. Thus, the subsequent conveyor rails 61 advance to a predetermined position and stop there. It should be noted that the transfer rail 83 is vibrated by a vibrator constantly or intermittently in synchronism with the delivery of the bags 11, thereby conveying the bags 11 on the transfer rail 83 forwardly. As the bags 11 are successively delivered from the transfer rail 83 to the packaging machine 3 by the bag delivery device 81, the number of bags 11 on the transfer rail 83 decreases. When the sensor senses that the number of remaining bags 11 has become less than a predetermined value, the push member 73 is activated again, whereby all the bags 11 in the conveyor rails 61 are forced into the transfer rail 83. This is repeated thereafter.

The first and second embodiments may be arranged such that the delivery of bags 11 is not performed when the top bags 11 are not present at a predetermined position, that is, when the top bags 11 have not yet been stopped and positioned at a predetermined position by the first stopper, at the time when the bag delivery device 81 should deliver bags 11 from the transfer rail 83 to the packaging machine 3. The fact that no bags are held on the corresponding bag holding member 8 of the packaging machine 3 is sensed with a sensor provided at the packaging machine 3, and operations such as filling of a material to be packed are not carried out for this bag holding member 8. Alternatively, the operations performed on the packaging machine 3 may be temporarily stopped.

As will be clear from the foregoing description, the spout-equipped bag feed apparatus 1 according to the present invention can hold spout-equipped bags 11 not only on the upper side of the conveying device 31 but also on the entire circumference thereof. Therefore, it is possible to store more than twice as many spout-equipped bags 11 as in the conventional apparatus per unit installation area of the apparatus. Accordingly, it is possible to reduce the number of times at which the bag feed apparatus 1 must be replenished with spout-equipped bags 11. The operation of replenishing the bag feed apparatus 1 with spout-equipped bags 11 need not be performed in the order in which the conveyor rails 61 are arranged side by side. Further, the replenishing operation can be carried out for any emptied conveyor rail 61 irrespective of whether the conveyor rail 61 is located above or below the chains 51. Therefore, the operator can perform the replenishing operation efficiently without restriction on his/her moving direction or the loading position.

It should be noted that the present invention is not limited to the foregoing embodiments but can be modified in a variety of ways.

What is claimed is:

1. An apparatus for feeding spout-equipped bags to a packaging machine to perform filling and packaging by using the spout-equipped bags, said apparatus comprising:

a holding member for conveying bags of continuous length having a bag support portion capable of being loaded with and unloaded of said spout-equipped bags at at least one end in an axial direction thereof, said bag support portion being adapted to hold spout portions of said spout-equipped bags in such a manner that said spout-equipped bags are movable in said axial direction;

a conveying device having an endless track, said conveying device having a plurality of said holding members for conveying bags attached thereto at a predetermined space in such a manner that the axial direction of said holding members for conveying bags extends in a direction perpendicularly intersecting a conveying direction of said conveying device, wherein said holding members for conveying bags are conveyed along an entire circumference of said endless track;

an unloading device for unloading said spout-equipped bags from one end of one of said holding members for conveying bags conveyed to a bag unloading position provided at a predetermined position along said endless track of said conveying device;

a bag receiving device for receiving the spout-equipped bags unloaded from said one of said holding members for conveying bags; and a delivery device for successively delivering the spout-equipped bags from said bag receiving device to bag holding members of said packaging machine.

2. An apparatus according to claim 1, wherein said holding member for conveying bags holds said spout-equipped bags in such a manner that bag portions of said spout-equipped bags extend from said holding member for conveying bags outward of said endless track.

3. An apparatus according to claim 2, wherein said holding member for conveying bags has a tubular member, at least one end of which is open, and said bag support portion is a slit formed in said tubular member, said slit extending from said one open end in an axial direction of said tubular member.

4. An apparatus according to claim 1, wherein said holding member for conveying bags has a tubular member, at least one end of which is open, and said bag support portion is a slit formed in said tubular member, said slit extending from said one open end in an axial direction of said tubular member.

5. A bag loading tool for loading spout-equipped bags into said holding member for conveying bags of said apparatus according to claim 1 through said one end of said holding member for conveying bags, said bag loading tool being formed as a member of continuous length and comprising:

a bag support portion capable of being loaded with and unloaded of said spout-equipped bags at least one end in an axial direction thereof, said bag support portion being adapted to hold the spout portions of said spout-equipped bags in such a manner that said spout-equipped bags are movable in said axial direction; and a guide portion formed at at least either one of said one end of said holding member of conveying bags and said one end of said bag loading tool to guide and position the other of said one end of said holding member for conveying bags and said one end of said bag loading tool;

wherein when said one end of said bag loading tool is butted against said one end of said holding member for conveying bags through said guide portion, said spout-equipped bags are movable from said bag support portion of said bag loading tool to said bag support portion of said holding member for conveying bags so as to be loaded into the holding member for conveying bags.

6. An apparatus for feeding spout-equipped bags to a packaging machine to perform filling and packaging by using the spout-equipped bags, said apparatus comprising:

a holding member for conveying bags of continuous length having a bag support portion capable of being loaded with and unloaded of said spout-equipped bags at at least one end in an axial direction thereof, said bag support portion being adapted to hold spout portions of said spout-equipped bags in such a manner that said spout-equipped bags are movable in said axial direction;

a conveying device having an endless track, said conveying device having a plurality of said holding members for conveying bags attached thereto at a predetermined space in such a manner that the axial direction of said holding members for conveying bags extends in a direction perpendicularly intersecting a conveying direction of said conveying device, wherein said holding members for conveying bags are conveyed along an entire circumference of said endless track;

an unloading device for unloading said spout-equipped bags from one end of one of said holding members for conveying bags conveyed to a bag unloading position provided at a predetermined position along said endless track of said conveying device;

a bag receiving device for receiving the spout-equipped bags unloaded from said one of said holding members for conveying bags;

a delivery device for successively delivering the spout-equipped bags from said bag receiving device to bag holding members of said packaging machine; and a bag loading tool of continuous length for loading said spout-equipped bags into said holding members for conveying bags;

wherein said bag loading tool has a bag support portion capable of being loaded with and unloaded of said spout-equipped bags at at least one end in an axial direction thereof, said bag support portion being adapted to hold the spout portions of said spout-equipped bags in such a manner that said spout-equipped bags are movable in said axial direction, wherein when said one end of said bag loading tool is butted against said one end of said holding member for conveying bags, said bag support portion of said bag loading tool connects with said bag support portion of said holding member for conveying bags so that said spout-equipped bags are movable from said bag loading tool to said holding member for conveying bags so as to be loaded thereinto.

7. A method of feeding spout-equipped bags to a packaging machine to perform filling and packaging by using the spout-equipped bags, said method comprising the steps of:

preparing a plurality of holding members for conveying bags of continuous length each capable of being loaded with and unloaded of said spout-equipped bags at at least one end in an axial direction thereof, said holding members for conveying bags being adapted to hold spout portions of said spout-equipped bags in such a manner that said spout-equipped bags are movable in said axial direction, said holding members for conveying bags being attached to a conveying device having an endless track at a predetermined space in such a manner that the axial direction of said holding members for conveying bags extends in a direction perpendicularly intersecting a conveying direction of said conveying device;

moving said holding members for conveying bags along an entire circumference of said endless track so that said spout-equipped bags can be loaded into said holding members for conveying bags in an any desired order at a plurality of positions along said endless track;

unloading said spout-equipped bags from one end of one of said holding members for conveying bags conveyed to a predetermined position along said endless track and sending said spout-equipped bags unloaded to an outside of said endless track; and successively supplying said spout-equipped bags sent out to said packaging machine.

8. A method according to claim 7, wherein said spout-equipped bags are loaded into each of said holding members for conveying bags by using a bag loading tool capable of being loaded with and unloaded of said spout-equipped bags at at least one end in an axial direction thereof, said bag loading tool being adapted to support said spout-equipped bags in such a manner that said spout-equipped bags are movable in said axial direction, wherein said one end of said bag loading tool is butted against said one end of said holding member for conveying bags, whereby said spout-equipped bags held on said bag loading tool are moved to said holding member for conveying bags so as to be loaded thereinto.

9. A method according to claim 8, wherein a guide portion is formed at at least either one of said one end of said holding member for conveying bags and said one end of said bag loading tool to guide and position the other of said one end of said holding member for conveying bags and said one end of said bag loading tool.

* * * * *